US007111353B2

(12) United States Patent
Cowdery

(10) Patent No.: US 7,111,353 B2
(45) Date of Patent: Sep. 26, 2006

(54) APPLICATOR

(76) Inventor: Dean J. Cowdery, 4701 Drew Ave. South, Minneapolis, MN (US) 55410

( * ) Notice: Subject to any disclaimer, the term of this patent is extended or adjusted under 35 U.S.C. 154(b) by 468 days.

(21) Appl. No.: 10/420,053

(22) Filed: Apr. 18, 2003

(65) Prior Publication Data

US 2004/0205922 A1 Oct. 21, 2004

(51) Int. Cl.
*A47L 1/06* (2006.01)
*A47L 13/10* (2006.01)

(52) U.S. Cl. ..... 15/209.1; 15/210.1; 15/244.1

(58) Field of Classification Search ..... 15/209.1, 15/210.1, 244.1, 244.2, 244.3, 235, 228, 15/220.1; 401/10; 451/502, 507
See application file for complete search history.

(56) References Cited

U.S. PATENT DOCUMENTS 815,343 A * 3/1906 Garnet ..... 15/228
2,662,269 A 12/1953 Nash ..... 492/24
2,756,449 A 7/1956 Dewey ..... 401/285
3,192,678 A * 7/1965 Buratti ..... 451/522
3,606,709 A * 9/1971 Countryman ..... 451/507
3,760,450 A * 9/1973 Griffin et al. ..... 15/229.6
4,134,173 A * 1/1979 Cupp et al. ..... 15/210.1
4,152,807 A 5/1979 Smahlik ..... 15/246
4,982,472 A * 1/1991 Lustofin ..... 15/244.1
5,492,425 A 2/1996 Carter et al. ..... 401/10
6,148,469 A 11/2000 Irven ..... 15/230.11
6,202,249 B1 * 3/2001 Jenkins et al. ..... 15/228

* cited by examiner

*Primary Examiner*—Gladys JP Corcoran
*Assistant Examiner*—Laura C Guidotti

(57) ABSTRACT

An applicator mounted on a hand T-bar tool has a split tube removably supported on the bar of the tool and a coating material applying sleeve secured to the tube. The tube and sleeve have upwardly and inwardly inclined opposite ends with bottom lips for applying coating materials and liquids to a floor adjacent a side wall.

20 Claims, 7 Drawing Sheets

114
117
111
123
100
122
112
113
118
116

114
117
100
122
111
113
116

117
100
122
111
116

117
114
121
17
17
122
112
100
116
119
113

APPLICATOR

FIELD OF THE INVENTION

The invention relates to hand tools used to apply coating materials to surfaces. The hand tool includes a T-bar supporting a tubular applicator operable to spread and apply a coating material on a surface, such as a floor.

BACKGROUND OF THE INVENTION

The largest and most used surface in most commercial and residential facilities is the floor. Hardwood floors are finished with oils and stains and are protected with coating materials, such as wax, varnish and epoxy. Ceramic and vinyl tile and concrete floors are protected with chemical and wear resistant materials that make the floors easy to refinish, maintain and repair. Hand tools, such as T-bars and wood blocks, are used to apply and spread the coating materials on the surfaces. The hand tools have applicator pads and brushes that are moved relative to the surface to apply and spread oils, stains, and coating materials to the surfaces. The peripheral edges of floors are adjacent lower edges of upright walls and panels. Baseboards and quarter round members are used on the upright walls to separate the floor from the upright walls. Hand tools with applicator pads and brushes must be carefully used to trim the peripheral edges of floors without applying stains, oils and coating materials to the upright walls or baseboards along the bottoms of the upright walls. Additional labor and supplies are needed to remove unwanted materials from the upright walls and baseboards.

SUMMARY OF THE INVENTION

The invention resides in an applicator used with a hand tool for applying materials to a surface, such as a floor. The applicator has a material spreading and applying sleeve moved with the hand tool over a surface to coat the surface with the material. The material includes, but is not limited to, liquids and semi-liquid cleaners, disinfectants, waxes, wood stains, varnishes, epoxy and urethane finishes. The hand tool is a T-bar took having an elongated cylindrical bar and a connector secured to a middle section of the bar. A socket accommodating a handle is pivotally connected to the connector to allow the socket and handle to be laterally moved relative to bar. The socket includes a yoke positioned on a head of the connector and a pin pivotally connecting the yoke to the head. The yoke and pin limit the movement of the socket and handle to lateral pivotal movements. The applicator has a split tubular member or tube positioned on the bar of the hand tool. The sleeve is secured to the tube. The tube and sleeve can be removed from the bar and environmentally cleaned or recycled. A new applicator is placed on the bar without the use of tools and fasteners. The sleeve has a core of flexible foam plastic and a fiber member joined to the outer portion of the core. The sleeve is a flocked foam member. Animal skins, such as lamb skin, is an alternative sleeve secure to the tube. The tube and sleeve have upwardly and inwardly tapered ends and lips at the lower portions of each end. The taper of each end is between 20 to 40 degrees relative to a transverse plane of the tubular member. The tapered ends and lips of the applicator allows the workperson to trim the surface with watery material without applying coating material to a side wall, baseboard, or structure extended upwardly from the surface. The ends of the bar are spaced from the sidewall by the applicator which prevents marring and scratching of the sidewall and baseboard.

DESCRIPTION OF THE PREFERRED EMBODIMENTS OF THE INVENTION

Figures 1, 2, 3, 4:
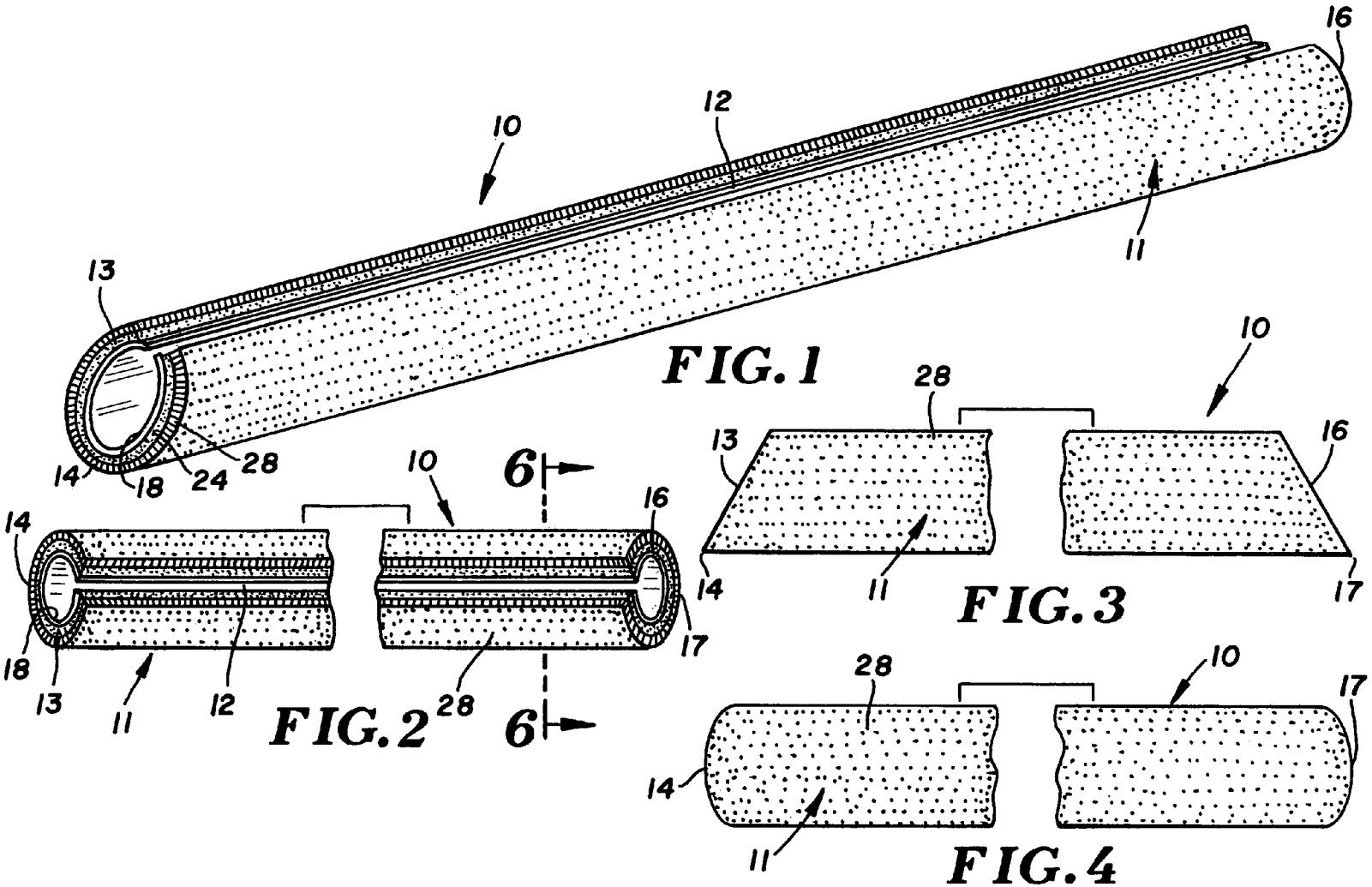
FIG. 1 is a perspective view of the material applicator of the invention.
FIG. 2 is a foreshortened top plan view thereof.
FIG. 3 is a foreshortened front elevational view thereof, the rear elevational view being a mirror image thereof.
FIG. 4 is a foreshortened bottom plan view thereof.
Figure 6:
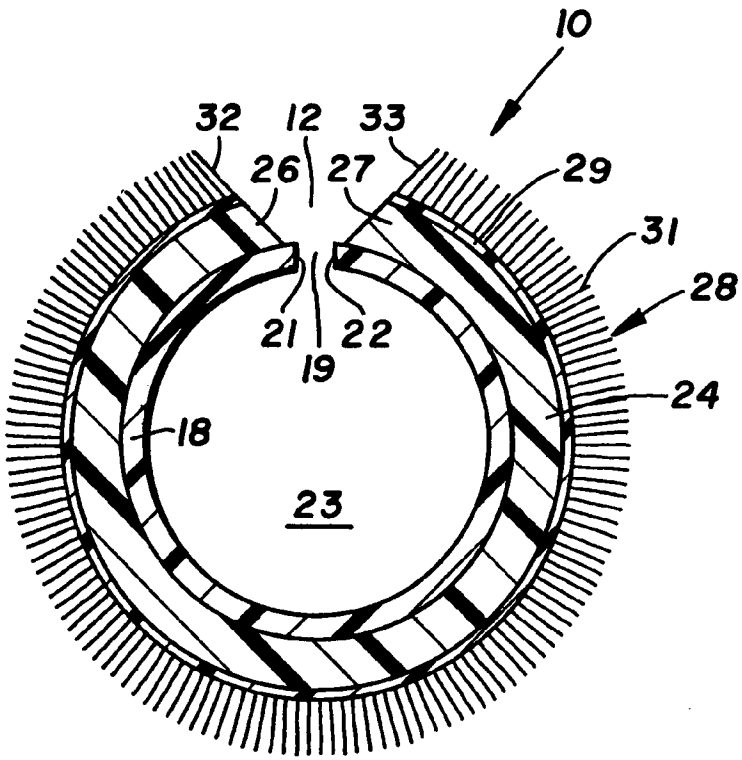
FIG. 6 is an enlarged sectional view taken along the line 6—6 of FIG. 2.
Figure 5:
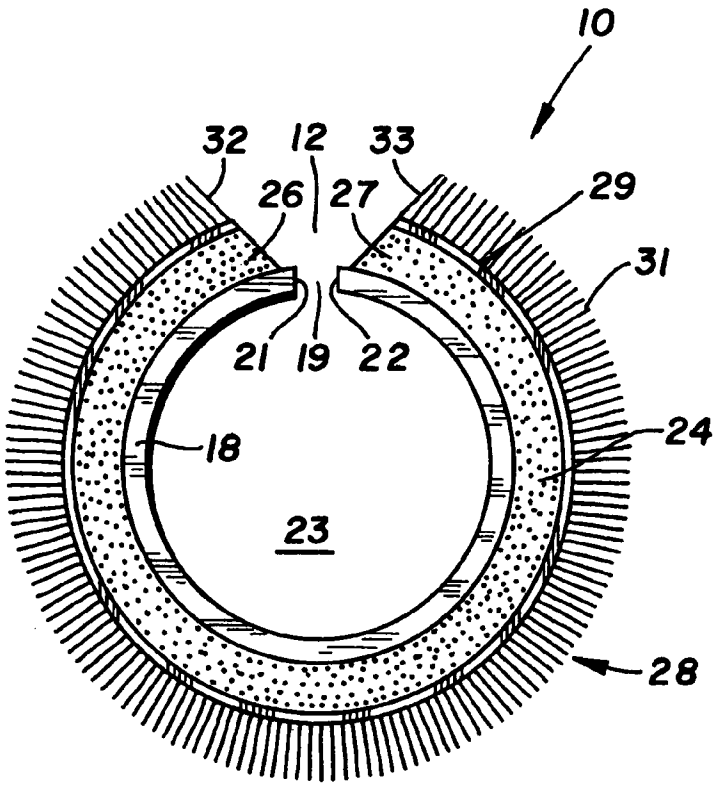
FIG. 5 is an enlarged end elevational view thereof, the opposite end being a mirror image thereof.

Referring to FIGS. 1 to 4, there is shown an elongated linear applicator 10 used to apply a layer or coating of material on a surface, such as wood, tile and concrete floors. Examples of the materials include, but are not limited to, liquid and semi-liquid cleaners, disinfectants, waxes, wood stains, varnish, epoxy and urethane finishes. Applicator 10 had an elongated generally cylindrical tubular member 11 having a linear slot 12 extended between the upper portions of tapered opposite ends 13 and 16. Each end 13 and 16 is upwardly and inwardly inclined at an angle of between 20 to 40 degrees relative to a vertical plane of the applicator. The angle of ends 13 and 16, shown in FIG. 3, is 30 degrees relative to the longitudinal axis if member 11. Tapered ends 13 and 16 can have other upwardly and inwardly inclined angles. End 13 has a lower lip 14 linearly aligned with a lower lip 17 at the bottom of end 16. Lips 14 and 17 are located below slot 12 and transversely aligned with slot 12. As shown in FIGS. 5 and 6, applicator 10 has an inside split tube 18 having a linear opening 19 between linear radial ends 21 and 22. Opening 19 is the inner portion or base of slot 12. Lips 14 and 17 are transversely aligned with opening 19. Tube 18 has an inside wall surrounding a linear cylindrical passage 23 having open opposite ends. The material of tube 18 is a rigid plastic, such as polyethylene. Other types of plastics and materials can be used to make tube 18.

A collar or core 24 of flexible plastic foam is secured to the outside of tube 18 with an adhesive or bonding material. Core 24 has uniform thickness and upwardly and outwardly directed ends 26 and 27. Core 24 is a flexible and compressible open cell polyester plastic foam. Other types of materials can be used for core 24.

A sleeve 28 comprises core 24 and a fiber member 30 secured to core 24. Fiber member 30 has a base layer 29 and outwardly directed fibers on hairs 31 joined to layer 29. Sleeve 28 is a flocked foam having generally linear outwardly directed fibers on the outer surface of core 24. Fiber member 30 has opposite ends 32 and 33 coextensive with the ends 26 and 27 of core 24. Fibers 31 are flexible strand members having generally uniform radial lengths. The radial lengths of fibers 31 is generally equal to the radial thickness of core 24. A fabric having flexible bristles or filaments can also be used for fiber member 30. An adhesive or bonding material can be used to secure the fabric to core 24.

Figure 7:
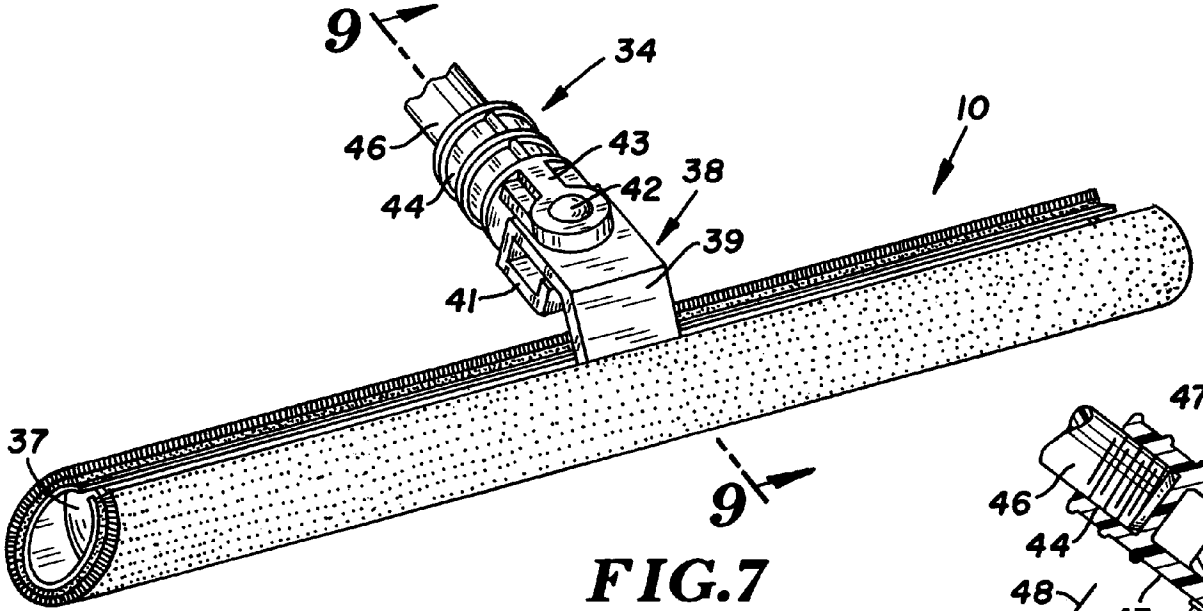
FIG. 7 is a perspective view of the material applicator of FIG. 1 mounted on a T-bar hand tool.
Figure 9:
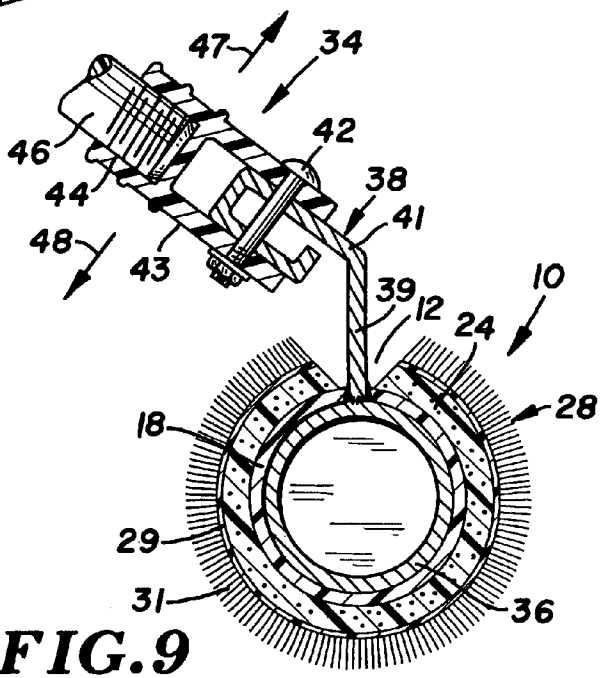
FIG. 9 is an enlarged sectional view taken along line 9—9 of FIG. 7.
Figure 8:
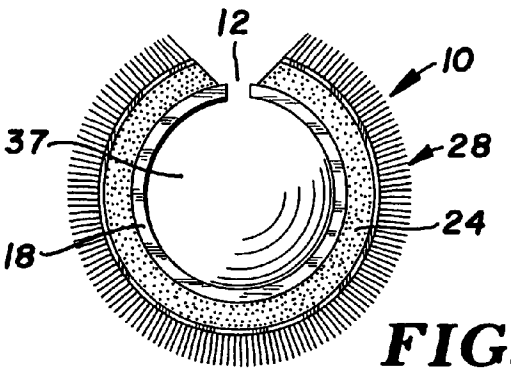
FIG. 8 is an enlarged end elevational view of FIG. 7.

As shown in FIGS. 7 to 9, a hand T-bar tool 34 has a linear cylindrical metal bar 36 located within passage 23 of split tube 18. Bar 36 has a diameter slightly larger than the inside diameter of split tube 18 whereby split tube 18 is biased into surface friction engagement with the outer cylindrical surface of bar 36. The surface frictional engagement of split tube 18 on bar 36 prevents lateral movement or shifting of applicator on bar 36. Applicator 10 can be removed from bar 36 by longitudinally separating tube 18 from bar 36. A new applicator can be mounted on bar 36 by longitudinally moving tube 18 on bar 36. The split tube 18 biases tube 18 into surface engagement with the outside surface of bar 36. Bar 36 is a cylindrical metal tube. Plugs 37 close the opposite open ends of tube 36. A connector 38 has an arm 39 extended through slot 12 and secured with welds to the center of bar 36. A U-shaped head 41 joined to arm 39 accommodates a pivot pin 42 that pivotally connects a yolk 43 to head 41. Arm 39 and head 41 is a one-piece metal member. Head 41 extends upwardly and rearwardly at an angle of about 45 degrees from the upright plane of arm 39. The angular relationship between arm 39 and head 41 can vary. Yolk 43 has an internally threaded socket 44 accommodating an elongated extension handle 46. Yolk 43 extends adjacent opposite sides of head 41 whereby handle 46 can be moved up and down, shown by arrows 47 and 48 to angularly turn application 10 relative to its longitudinal axis. Pivot pin 42 allows handle 46 to be angularly moved in lateral directions, as shown by arrows 49 and 51 in FIG. 10. This allows the use of applicator 10 when the workperson is laterally positioned relative to the surface being coated with material.

Figure 11:
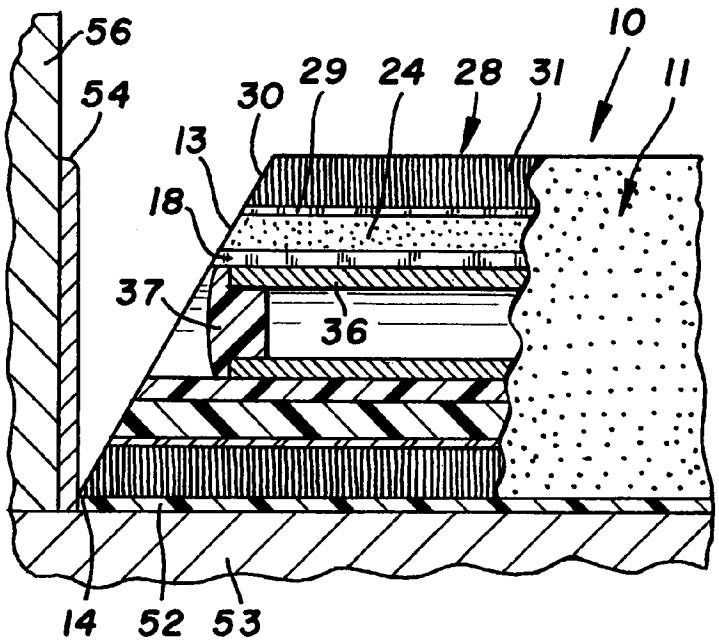
FIG. 11 is an enlarged end view, partly sectioned, of the material applicator and T-bar of FIG. 10.
Figure 10:
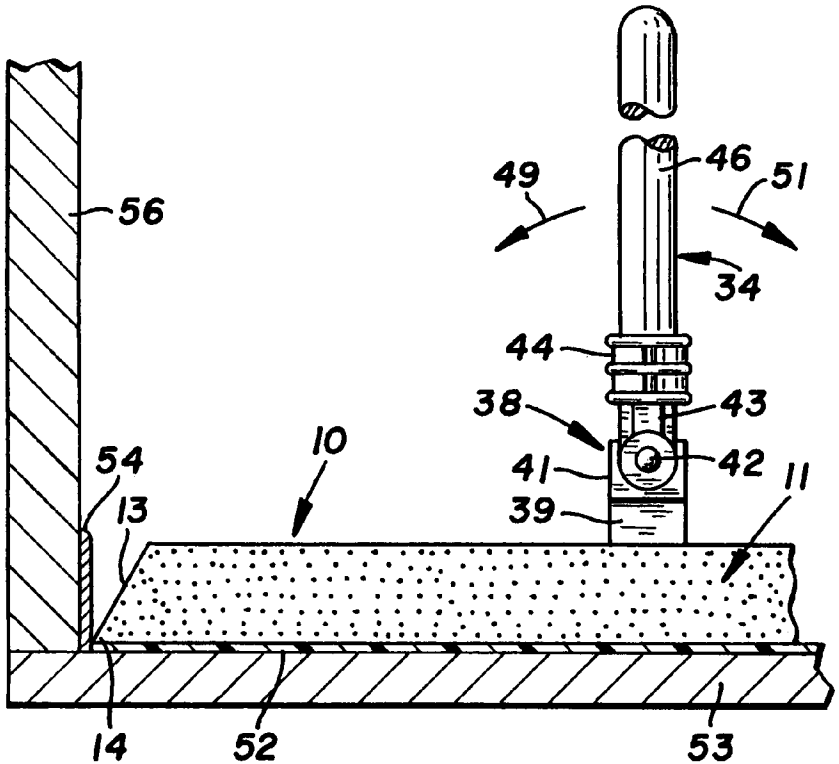
FIG. 10 is a front elevational view of the material applicator and T-bar tool used to apply a layer of material on a floor adjacent an upright wall.

Referring to FIGS. 10 and 11, applicator 10 is used to apply a coating or layer of material 52 to the surface of a floor 53. The workperson manually uses handle 46 to move applicator 10 along floor 53. Sleeve 28 spreads material 52 on the surface of floor 53 in a generally uniform layer. The tapered end 13 of applicator 10 is spaced from baseboard 54 which is attached to the lower end of side wall 56. Baseboard 54 is a flat member, such as a wood or plastic strip, secured to side wall 56 with fasteners or an adhesive. Quarter round members (not shown) are also used at the juncture between floor 53 and side wall 56. Tapered end 13 of applicator 10 extends away from baseboard 54 with only lip 14 located adjacent the bottom of baseboard 54. Lip 14 trims the coating of material 52 to the bottom of baseboard 54 and prevents the application of material to the outside surface of baseboard 54. As seen in FIG. 11, the ends of split tube 18 and plug 37 are laterally spaced from baseboard 54 to prevent marring and scratching baseboard 54 and applying material thereto. The lower section of the flexible collar 24 and sleeve 28 of tubular member 11 provides a resilient cushion that maintains the lateral space relationship between the end of split tube 18 and baseboard 54.

Figures 12, 13, 14, 15:
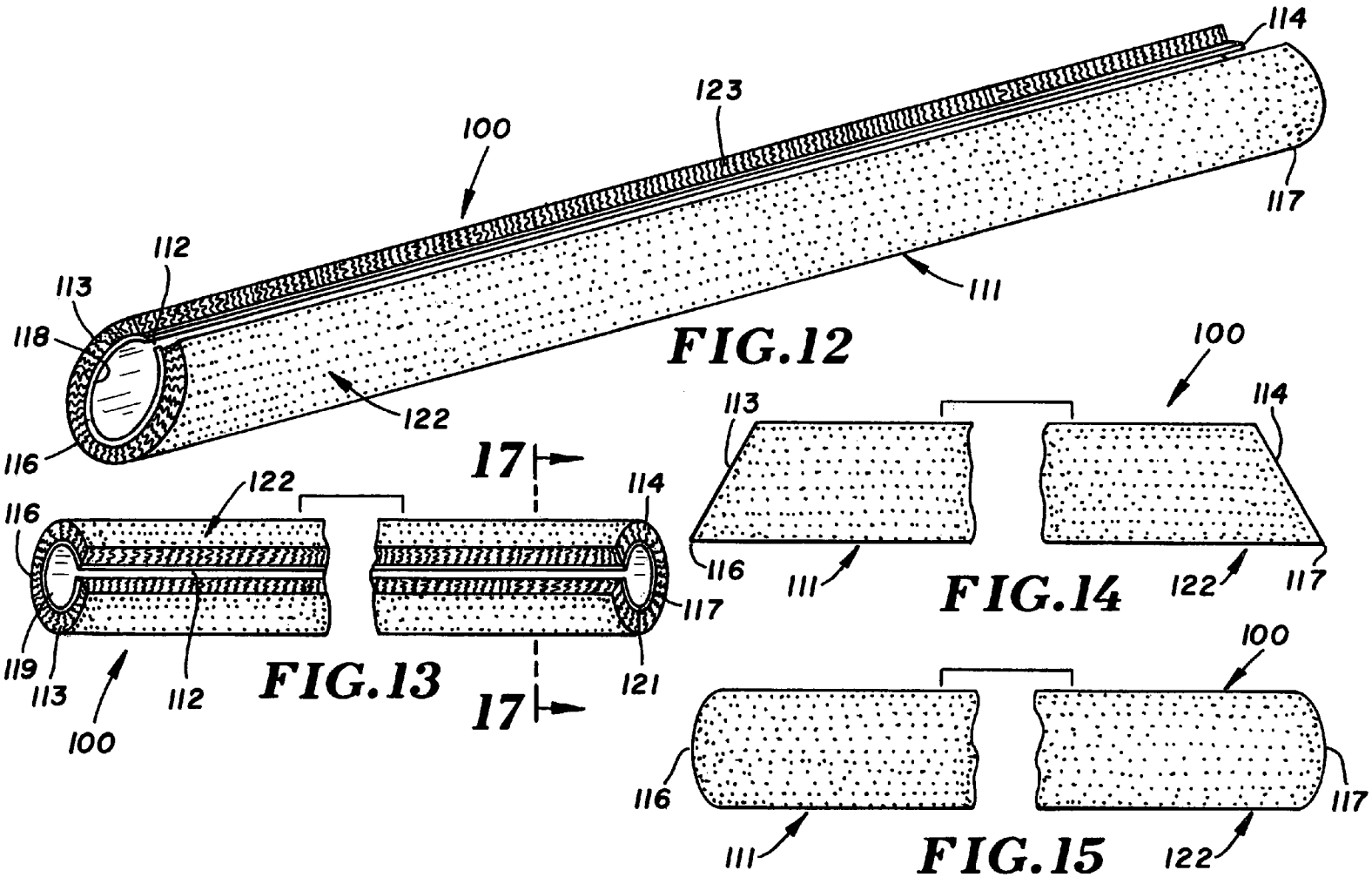
FIG. 12 is a perspective view of a first modification of the material applicator of FIG. 1.
FIG. 13 is a foreshortened top plan view of FIG. 12.
FIG. 14 is a foreshortened front elevational view of FIG. 12.
FIG. 15 is a foreshortened bottom plan view of FIG. 12.

A first modification of the applicator, indicated generally at 100 in FIGS. 12 to 17, is useable with hand T-bar tool 34 to apply material to a surface. Applicator 100 is an elongated generally cylindrical tubular member 111 having an elongated linear slot 112 along the top portion thereof for accommodating connector 38 of manual T-bar tool 34. Member 111 has upwardly and inwardly inclined or tapered opposite ends 113 and 114. Ends 113 and 114 incline or slope at an angle between 20 to 40 degrees relative to the longitudinal axis of member 111. The angle of ends 113 and 114 show in FIG. 14 is 30 degrees relative to the longitudinal axis of member 111. Tapered ends 113 and 114 can have other upwardly and inwardly inclined angles. Ends 113 and 114 have bottom or lower lips 116 and 117 that function to apply material to the surface adjacent the upright wall, as illustrated with member 11 in FIGS. 10 and 11. Lips 116 and 117 are below slot 112 and transversely aligned with slot 112.

Figure 17:
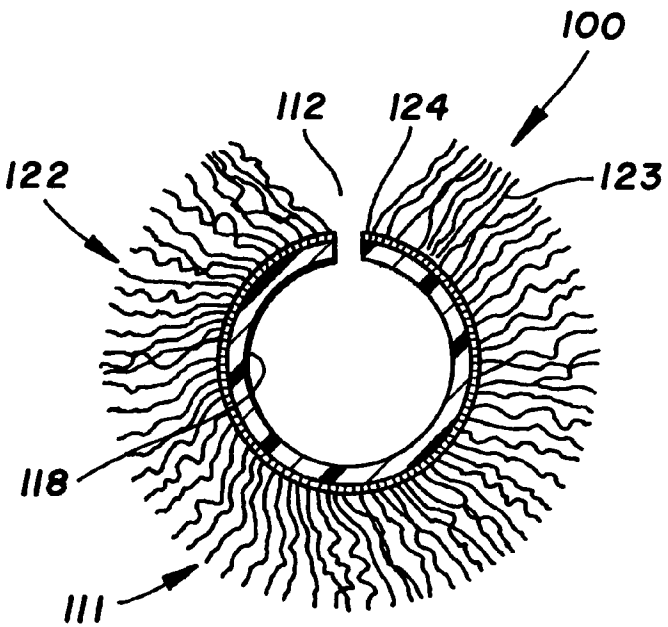
FIG. 17 is an enlarged sectional view taken along line 17—17 of FIG. 13.
Figure 16:
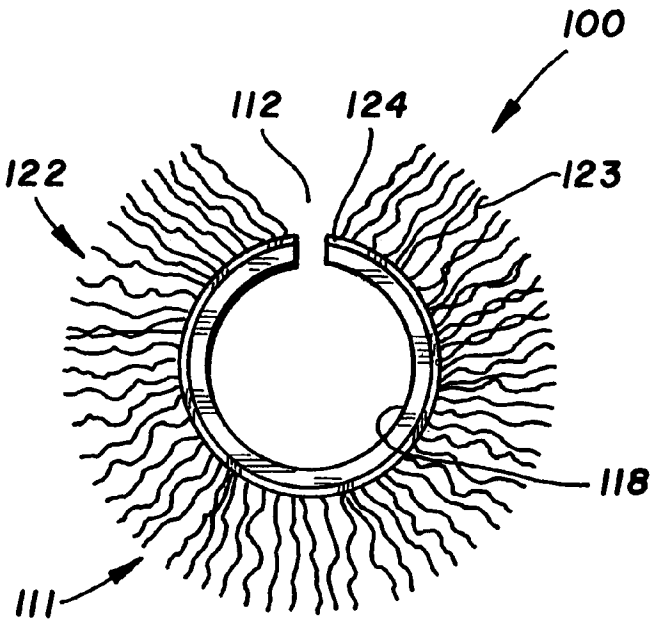
FIG. 16 is an enlarged end elevational view of FIG. 12.

As shown in FIGS. 16 and 17, member 111 has a generally cylindrical split tube 118 having opposite tapered ends 119 and 121. Tube 118 is a rigid plastic tube supporting a sleeve 122 having elongated flexible fibers 123 joined to a base layer 124. Sleeve 122 is the integument of a lamb having a skin and wool fibers. Pelts and skins of other animals can be used for sleeve 122. Wool fibers 123 are cut to have a radial thickness of about ¾ inch (1.5 cm). Base layer 124 is secured with an adhesive or bonding material to the outer surface of tube 118. In use, the mat of fibers 123 retains the coating material and applies and spreads the coating material to the surface. The tapered ends 113 and 114 of applicator 100 incline away from the side wall or baseboard on the side wall to prevent coating material to be applied to the side walls, as shown by applicator end 13 in FIGS. 10 and 11.

Figure 18:
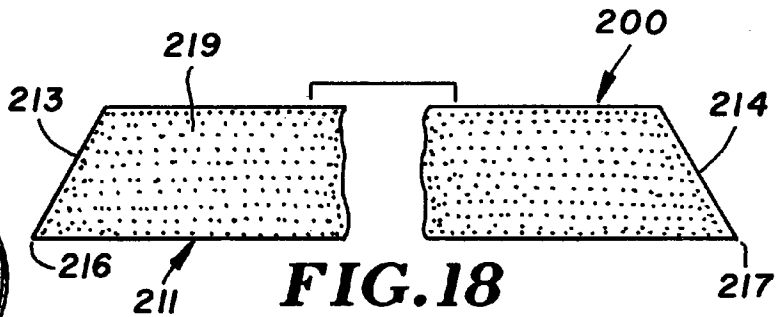
FIG. 18 is a foreshortened front elevational view of a second modification of the material applicator of FIG. 1.
Figure 20:
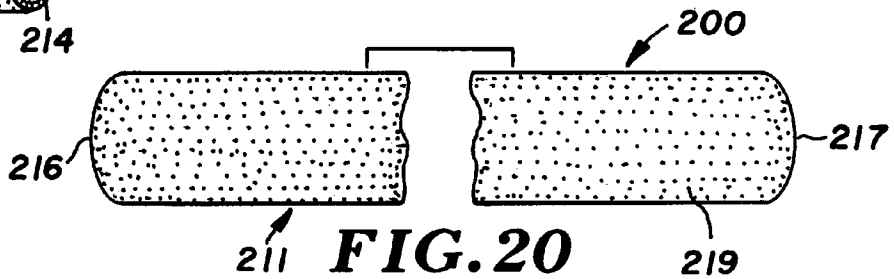
FIG. 20 is a bottom plan view of FIG. 20.
Figure 19:
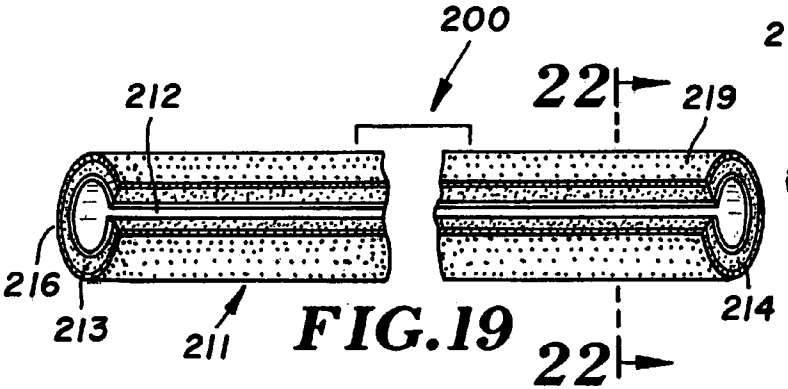
FIG. 19 is a foreshortened top plan view of FIG. 18.
Figure 22:
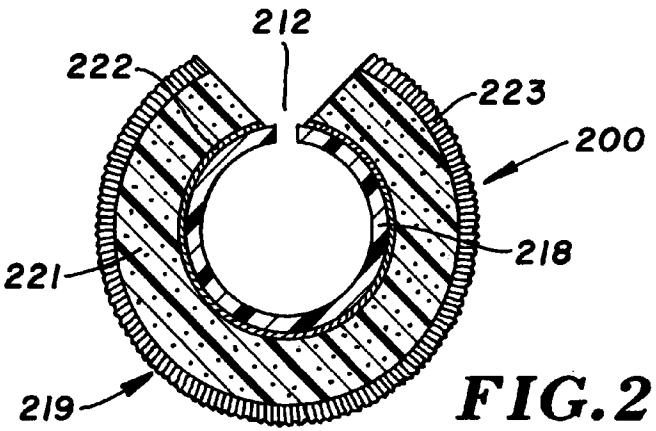
FIG. 22 is an enlarged sectional view taken along line 22—22 of FIG. 19.
Figure 21:
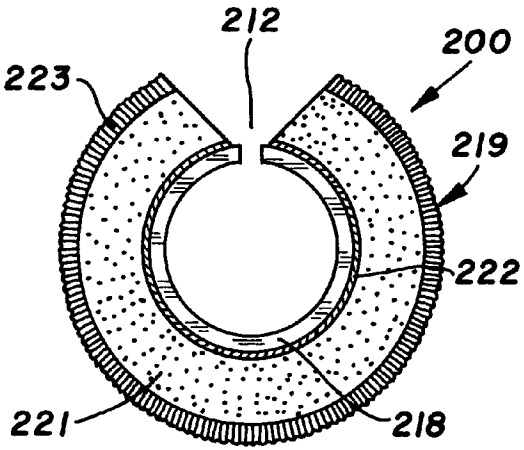
FIG. 21 is an enlarged end elevational view of FIG. 18.

A second modification of the applicator, indicated generally at 200 in FIGS. 19 to 22, is adapted to fit on the bar 36 of hand T-bar tool 34. Applicator 200 is an elongated generally cylindrical tubular member 211 having an elongated linear slot 212 for accommodating the connector 38 of manual T-bar tool 34. The opposite ends 213 and 214 of member 211 incline or taper upwardly and inwardly at angles between 20 to 40 degrees relative to the longitudinal axis of member 211. The angles of ends 213 and 214 shown in FIG. 18 is 30 degrees relative to the longitudinal axis of member 211. Tapered ends 213 and 214 can have other upwardly and inwardly inclined angles. The lower portions of ends 213 and 214 have lips 216 and 217 that function to scrub the surface of the floor adjacent the side wall with a minimum contact with the side wall. Lips 216 and 217 are below slot 212 and transversely aligned with slot 212. Member 211 has a plastic split tube 218 supporting a sleeve 219. As shown in FIGS. 21 and 22, sleeve 219 has an open cell foam inner layer or core 221 secured with an adhesive 222 to the outer surface of tube 218. A layer or mat 223 of abrasive plastic fibers is bonded to the outer surface of core 221. Mat 223 can be sand paper. Core 221 and mat 223 are flexible whereby the sleeve 219 can be pressed into firm surface engagement with the floor or surface. The abrasive plastic fibers scrub the floor and apply coating material to the floor without marring or scratching the side wall or baseboard on the side wall.

There has been shown and described an applicator and hand tool accommodating the applicator for applying materials to surfaces. Changes, modifications, variations in structures and materials and uses of the applicator and hand tool may be made by persons skilled in the art without departing from the scope and content of the invention.

The invention claimed is:

1. A combined hand tool and applicator useable for applying a material to a surface comprising:

a T-bar tool having an elongated cylindrical bar, said bar having a continuous cylindrical outer surface and a generally uniform diameter and opposite ends, a handle secured to the bar between said opposite ends thereof, an applicator including an elongated linear rigid tubular member having a generally cylindrical outer surface, an inside cylindrical surface having an inside diameter, said diameter of the bar being larger than the inside diameter of the tubular member, said tubular member surrounding and located in biased surface friction engagement with the continuous cylindrical outer surface of the bar, opposite ends of the tubular member extended outwardly from the opposite ends of the bar, and a linear slot extended longitudinally between said opposite ends of the tubular member, a sleeve surrounding said outer surface of the tubular member, said sleeve having opposite ends adjacent the opposite ends of the tubular member, each of said opposite ends of the sleeve having a lip below and transversely aligned with the slot in the tubular member, said opposite ends of the tubular member and sleeve tapering upwardly and inwardly toward said slot in the tubular member, and means securing the sleeve to the outer surface of the tubular member.

2. The hand tool and applicator of claim 1 wherein: said sleeve includes a flexible foam plastic core and a plurality of fibers extended outwardly from the core.

3. The hand tool and applicator of claim 2 wherein: said fibers are flocked foam fibers.

4. The hand tool and applicator of claim 2 wherein: said plastic core is a polyester open cell foam plastic.

5. The hand tool and applicator of claim 1 wherein: said sleeve is an integument of an animal hide.

6. The hand tool and applicator of claim 5 wherein: said hide is a lamb skin.

7. The hand tool and applicator of claim 1 wherein: said sleeve is the pelt of an animal.

8. The hand tool and applicator of claim 1 wherein: said sleeve includes a flexible plastic core having an outer surface and a layer of abrasive fibers secure to the outer surface of the core.

9. The hand tool and applicator of claim 1 wherein: each of the opposite ends taper upwardly and inwardly at an angle between 20 to 40 degrees the transverse plane of the tubular member.

10. The hand tool and applicator of claim 1 wherein: the bar is a linear tube having opposite ends and plugs located in the opposite ends of the tube, said plugs being located inwardly of the opposite ends of the sleeve.

11. A combined hand tool and applicator useable for applying a material to a surface comprising: a T-bar tool having an elongated cylindrical bar, said bar having a continuous cylindrical outer surface and a generally uniform diameter and opposite ends, a connector secured to a central portion of the bar, a socket adapted to be connected to a handle, means pivotally connecting the socket to the connector whereby the socket can be angularly moved relative to the bar, an applicator including an elongated linear tubular member having an inside cylindrical surface having an inside diameter, said diameter of the bar being larger than the inside diameter of the tubular member, said tubular member surrounding and located in biased surface friction engagement with said continuous cylindrical outer surface of the bar, a generally cylindrical outer surface, opposite ends of the tubular member located outwardly from the opposite ends of the bar, and a linear slot extended longitudinally between said opposite ends of the tubular member, said connector extended through said slot, a sleeve surrounding said outer surface of the tubular member, said sleeve having opposite ends adjacent the opposite ends of the tubular member, each of said opposite ends of the sleeve having a lip below and transversely aligned with the slot in the tubular member, said opposite ends of the tubular member and sleeve tapering upwardly and inwardly toward said slot in the tubular member, and means securing the sleeve to the outer surface of the tubular member.

12. The hand tool and applicator of claim 11 wherein: said sleeve includes a flexible foam plastic core and a plurality of fibers extended outwardly from the core.

13. The hand tool and applicator of claim 12 wherein: said fibers are flocked foam fibers.

14. The hand tool and applicator of claim 12 wherein: said plastic core is a polyester open cell foam plastic.

15. The hand tool and applicator of claim 11 wherein: said sleeve is an integument of an animal hide.

16. The hand tool and applicator of claim 15 wherein: said hide is a lamb skin.

17. The hand tool and applicator of claim 11 wherein: said sleeve is the pelt of an animal.

18. The hand tool and applicator of claim 11 wherein: said sleeve includes a flexible plastic core having an outer surface and a layer of abrasive fibers secure to the outer surface of the core.

19. The hand tool and applicator of claim 11 wherein: each of the opposite ends of the tubular member and sleeve taper upwardly and inwardly at an angle between 20 to 40 degrees from the transverse horizontal plane of the tubular member.

20. The hand tool and applicator of claim 11 wherein: the bar is a linear tube having opposite ends and plugs located in the opposite ends of the tube, said plugs being located inwardly of the opposite ends of the sleeve.

* * * * *